United States Patent [19]

Pohl

[11] 4,295,114

[45] Oct. 13, 1981

[54] THERMO-SWITCH

[75] Inventor: Walter Pohl, Milan, Italy

[73] Assignee: Eaton Corporation, Cleveland, Ohio

[21] Appl. No.: 115,977

[22] Filed: Jan. 28, 1980

[30] Foreign Application Priority Data

Jan. 29, 1979 [IT] Italy ..... 19684 A/79

[51] Int. Cl.[3] ..... H01H 61/01

[52] U.S. Cl. ..... 337/3; 337/354; 337/364

[58] Field of Search ..... 337/3, 16, 343, 354, 337/362, 365

[56] References Cited

U.S. PATENT DOCUMENTS 3,700,969 10/1972 Furnival ..... 337/3 X 3,715,697 2/1973 Them ..... 337/3 X

*Primary Examiner*—George Harris

*Attorney, Agent, or Firm*—R. J. McCloskey; R. A. Johnston

[57] ABSTRACT

A thermostatic switch (10) employs a switch blade (22) having spaced thereon a set of service contacts (16, 20).

One end of the blade is supported by a heat collapsible support (46) and a second set of contacts (26, 24), the contact sets being electrically in series. The service contacts are actuated by a slider (30) driven by a bi-metallic heat sensing element (32). A spring loaded button (52) biases the blade (22) against the collapsible support. Both sets of contacts (16, 20), (26, 24) are normally closed and upon the thermostat experiencing excessive temperatures the heat-collapsible support yields to the force of the bias spring (54) and causes the second set of contacts (26, 24) to open irrespective of the condition of the service contacts (16, 20).

6 Claims, 2 Drawing Figures

THERMO-SWITCH

BACKGROUND OF THE INVENTION

This invention relates to a thermostat, particularly a bimetallic thermostat, applicable to heating apparatus in general such as, for example, hot water heaters, radiators and furnaces.

The present invention provides a bimetallic thermostat able to interrupt the electric feed circuit to the using equipment safely and quickly, not only under normal conditions but also when abnormal input of electric power occurs in the user equipment controlled by said thermostat. When these conditions occur, it is possible that, because of the high current in circulation, melting of switch contacts will occur. The consequent melting of the contacts prevents timely opening of the switch.

SUMMARY OF THE INVENTION

The thermostat according to the invention is designed and made to interrupt the feed circuit to the using equipment when an abnormal electrical input occurs for the using equipment, especially when the switch operated by the thermostat does not intervene for some reason.

The present invention provides a thermostat which not only controls the electric circuit feeding the using equipment, but also rapidly interrupts this electric circuit independently of the conditions of the switch contacts, thus assuring the opening of said feed circuit, even when the switch contacts are fused together.

The present invention provides a thermostat that is easy to make and reliable, especially in regard to its electrical performance. The present device is easy to install and exhibits a limited size which is necessary and essential for some using equipment and yet the operational characteristics and reliability of the thermostat are not compromised by its relatively small size.

The thermostat according to the invention employs temperature sensitive means to control an electric switch comprising an elastic strip held at one of its ends by one of the terminals of the switch, and is characterized in that the elastic strip of the switch comprises at its free end complementary contacts connected in series to the contacts of the switch. Heat sensitive means act on the first contacts, while fusible means sensitive to the temperature to be controlled act on second contacts and, in opposition to the action performed by the elastic means on part of the second set contacts, keep these latter closed. In the event the sensitive fusible means melt, the second set of contacts opens causing the interruption of the feed circuit of the using equipment, independently of the position assumed from time to time by the first set of contacts of said switch.

In one embodiment of the thermostat the elastic strip of the switch comprises at its free end an elastic portion that engages by opposition a fusible block so that when this latter is whole, i.e., not yet fused, it keeps the second set of contacts closed independently of the first set of contacts of the switch. Upon fusion or melting of said block the second set of contacts is opened independently of the contacts of said switch.

The invention will now be explained by the following description with reference to the accompanying drawing which illustrates by way of example an embodiment of a thermostat suitable for controlling the feed to electrical equipment, such as, for example, hot water heaters, furnaces and similar household appliances.

DETAILED DESCRIPTION

Figure 1:
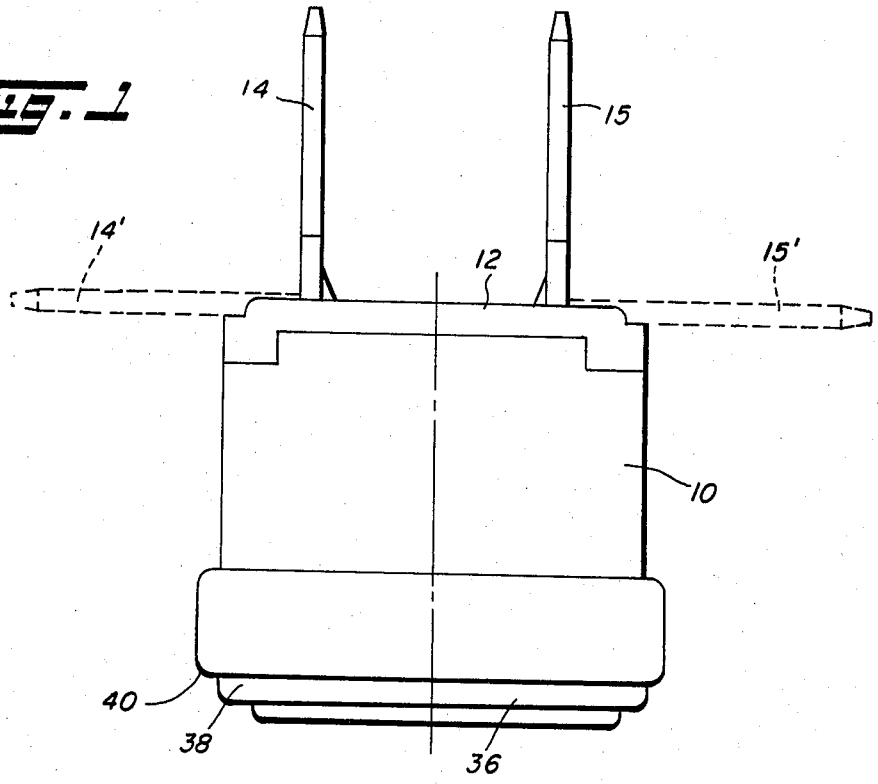
FIG. 1 is an elevation view of the thermostat.
Figure 2:
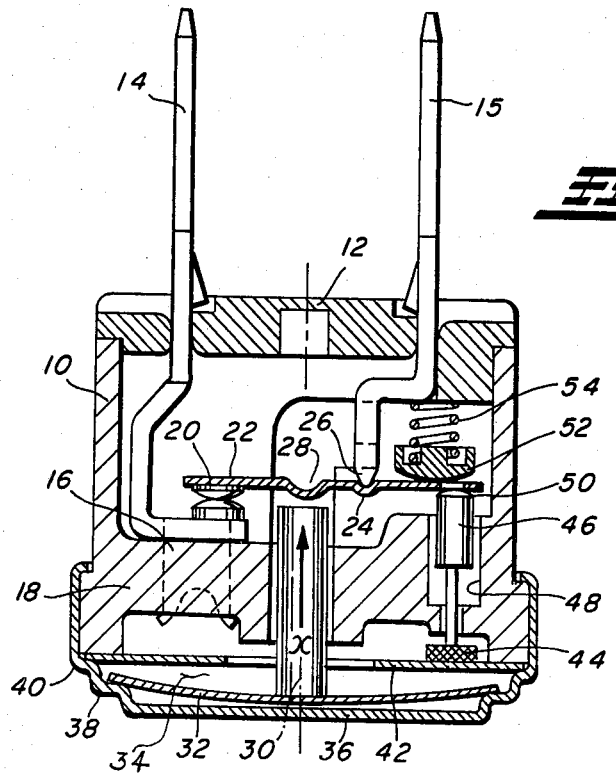
FIG. 2 is a vertical section of the thermostat of FIG. 1.

The thermostat shown is made up of a casing 10 whose cover 12 is of an electrically insulating material and which holds two terminals 14 and 15 of a type suitable for insertion of the thermostat in the feed line of the using equipment. In the embodiment shown, terminals 14 and 15 are of the type with plates placed parallel between them that can be engaged in the electric line by suitable connectors. These terminals can be, if desired, bent at right angles as shown at 14', 15' by dotted lines in FIG. 1.

Terminal 14 extends inside casing 10 and ends in a square end 16 suitably fixed to the bottom 18 of said casing to constitute the stationary contact of the switch that controls the feed to the using equipment. Stationary contact 16 cooperates with a movable contact 20 provided on one of the ends of an elastic strip 22, disposed in suitable position and having a recess in the form of a crosswise notch 24 in which the knife-edge end 26 of a plate, comprising the extension of terminal 15 is engaged. The engagement between end 26 and the walls of notch 24 is such that a satisfactory electrical contact is assured. Parts 24 and 26 constitute a second or complementary set of contacts, placed electrically in series, to switch contacts 16 and 20 in relation to the aims that will be described below.

Elastic strip 22 is provided in its median part with a downwardly extending projection or boss 28 which engages the end of a slider 30 received in a hole made in bottom 18 of casing 10 and guided for vertical movement therein. The lower end of slider 30 contacts the central zone of a bimetallic member 32 constituting the heat sensitive element of the thermostat. This member 32 normally exhibits a concave swelling and, under the action of heat, is deformed, modifying its concavity to urge slider 30 upwardly to thereby trip the contactor of the electric switch. Member 32 is housed, with suitable play, in a space 34 defined by the inside of a metal cap 36, having two annular shoulders 38 and 40 placed in a stepped manner, the first of which, with suitable play, holds the edge of the bimetallic member 32.

Cap 36 is fastened by a rim to the grooved periphery of casing 10 to lock between the edge of this casing and the shoulder 40 the edge of a drilled disk 42 of thermally conductive metal. Cap 36 and disk 42 are in metal-to-metal contact; and, on the upper face of disk 42 and toward its edge is fastened a block 44 made up of material, preferably fusible metal, that melts at a determined temperature of the using equipment and which is sensed by metal cap 36.

The free face of fusible block 44 is engaged with the lower end of a pushrod 46 housed to slide in a hole 48 provided by the lower portion 18 of casing 10. The upper end of pushrod 46 is curved and engages the end 50 constituting an extension of the free end of elastic strip 22 to extend on the opposite side of notch 24. The other face of end 50, substantially opposite the end of pushrod 46, is engaged by an electrically insulating projection 52, registering against the lower end of a spring 54. Spring 54 is held on its other end by cover 12 to transmit its elastic action to end 50 of member 22 and to fusible block 44 underneath.

In operation, the temperature to be controlled is sensed by the thermostat through cap 36 and the heat is transmitted by the latter either to the bimetallic member 32 or, through disk 42, to fusible block 44. Consequently, member 32 is deformed and, reversing its concavity, pushes slider 30 in the direction of arrow X to open, by upward movement of contact 20, the electric feed circuit to the using equipment.

When the temperature sensed by the thermostat increases beyond the preset limit for any reason, independently or not of the intervention of switch contacts 16–20 which control the using equipment, the excess temperature is sensed and fusible block 44 melts as soon as the critical temperature is reached. Upon melting of block 44, pushrod 40 moves downwardly under the elastic action of end 50 of member 22, thereby allowing notch 24 of elastic strip 22 to disengage from the blade end of terminal 15. Interruption of the electric circuit is thus assured and aided by the urging of bias spring 54 on end 50 of strip 22. When block 44 melts, the interruption of the electric circuit is performed independently of the position assumed by contacts 16, 20; therefore, the interruption of the circuit is always assured even when these contacts are fused closed, by currents or other known causes.

Thus, the present invention provides a thermostatic sensor device which assures the interruption of the controlled circuit even when the thermostat service switch does not work.

It will be apparent to those skilled in the art that modification and variants can be made to the sensor described and illustrated hereinabove within the scope of the invention which is limited only by the following claims.

I claim:

1. An overload protective thermostat comprising:

(a) housing means;

(b) switch means disposed within said housing means, said switch means including a switch blade member mounted on a support for movement between positions making and breaking first and second spaced sets of circuit contacts;

(c) heat responsive service actuator means disposed within said housing means, said actuator means being operative in response to experiencing a predetermined service temperature to cause movement of said switch member for breaking said first set of electrical contacts;

(d) collapsible support means maintaining said switch member in a position such that said first and second sets of contacts are normally closed; and, (e) means biasing said switch member against said support means in a direction tending to open said second set of contacts wherein upon said thermostat experiencing temperatures above a second predetermined level greater than said service temperature, said support means collapses permitting said bias means to open said second set of contacts irrespective of the condition of said first set of contacts;

(f) a first electrical terminal, operatively connected in series circuit arrangement with said first set of contacts and adapted for connection thereto externally of said housing means; and (g) a second electrical terminal operatively connected in series circuit arrangement with said second set of contacts and adapted for connections thereto externally of said housing means.

2. The thermostat defined in claim 1, wherein said collapsible support means includes a fusible link which melts at said predetermined temperature.

3. The thermostat defined in claim 1 wherein said service actuator means includes a bi-metal member.

4. The thermostat defined in claim 1, wherein said switch blade member is formed of elastically deformable electrically conductive material.

5. The thermostat defined in claim 1 wherein, (a) said switch blade member is formed of elastically deformable electrically conductive material;

(b) said second set of contacts defines a fulcrum for elastic deformation of said switch blade member by said service actuator means.

6. The thermostat defined in claim 1, wherein said means biasing said switch member against said support includes spring means registering against said housing means.

* * * * *